US005507430A

United States Patent [19]

Imhoff

[11] Patent Number: 5,507,430

[45] Date of Patent: Apr. 16, 1996

[54] SHIPPING CONTAINER APPARATUS CONVERTIBLE FOR USE AS A DISPLAY APPARATUS FOR GOODS

[75] Inventor: Scott M. Imhoff, Arlington Heights, Ill.

[73] Assignee: Stone Container Corporation, Chicago, Ill.

[21] Appl. No.: 329,211

[22] Filed: Oct. 26, 1994

[51] Int. Cl.[6] ..... B65D 43/08

[52] U.S. Cl. ..... 229/125.19; 229/117.13; 229/125.33; 229/211

[58] Field of Search ..... 229/117.13, 211, 229/240, 125.19, 125.33, 141, 145, 154, 164

[56] References Cited

U.S. PATENT DOCUMENTS

| | | | |
|---|---|---|---|
| 1,960,925 | 5/1934 | Senat | 229/125.19 X |
| 2,583,211 | 1/1952 | Fleming | 229/211 X |
| 3,055,573 | 9/1962 | Carter | 229/125.19 X |
| 3,235,166 | 2/1966 | Guyer | 229/125.19 X |
| 3,910,483 | 10/1975 | Ritter | 229/125.33 X |
| 3,967,774 | 7/1976 | Querner | 229/125.19 |
| 4,848,651 | 7/1989 | Hartness | 229/125.33 |

*Primary Examiner*—Allan N. Shoap
*Assistant Examiner*—Christopher J. McDonald
*Attorney, Agent, or Firm*—Dick and Harris

[57] ABSTRACT

A shipping container apparatus for goods, convertible for use as a display apparatus for the goods. A tray, which holds and displays the goods, has a bottom panel member and at least one tray wall member, which includes at least one integrated separable member. A lid is releasably attached to the tray for covering the goods during shipping. The lid at least one lid wall member positionable over at least a portion of the tray wall member. The lid wall member includes at least one flap member, which is moveable from a substantially closed position to a substantially open position. The flap member of the lid means is positionable over and attachable to at least a portion of the frangibly integrated separable member. Attachment of the flap member of the lid means to a frangibly integrated separable member maintains the lid means and tray means attached to each other as an integrated shipping container. Movement of the flap member from the substantially closed position to the substantially opened position in turn separates the frangibly integrated separable member from the tray wall member. This, in turn, permits removal of the lid means from the tray means, converting the tray means absent the frangibly integrated separable member to a display apparatus for the goods.

20 Claims, 3 Drawing Sheets

SHIPPING CONTAINER APPARATUS CONVERTIBLE FOR USE AS A DISPLAY APPARATUS FOR GOODS

BACKGROUND Of THE INVENTION

The present invention relates in general to a shipping container apparatus for goods, and, more particularly, to a shipping container apparatus for goods which is convertible for use as a display apparatus for the goods.

The practice of displaying goods for sale within their shipping containers is enjoying widespread popularity, especially at outlet stores and discount supermarkets. This practice allows vendors of the goods to quickly move the goods from a dock or storage area and onto store shelves for display to consumers—without arrangement of the stored articles to the shelf. Often, a knife is used to cut away a top portion of a shipping container, in order to convert the shipping container into a display tray for the enclosed goods. This practice is often time consuming, may result in damage to the goods through inadvertent contact with the knife during this cutting, as well as dangerous to the individual cutting the box down into a tray. Moreover, this practice often results in a display tray having a ragged, unappealing visual appearance.

Accordingly, it is an object of the present invention to provide a shipping container apparatus for goods which is convertible for use as a display apparatus for the goods. It is another object of the present invention to provide a structurally sound shipping container apparatus for goods having a lid which is securely attachable to a tray, yet easily removable from the tray for purposes of displaying the transported goods.

These and other objects and features of the present invention will become apparent in light of the present specification, claims and drawings.

SUMMARY OF THE INVENTION

The present invention comprises a shipping container apparatus for goods, convertible for use as a display apparatus for the goods. The shipping container apparatus includes tray means for holding and displaying the goods. The tray means has a bottom panel member and at least one tray wall member. The tray wall member includes at least one integrated separable member.

Lid means, releasably attached to the tray means, are provided for covering the goods during shipping. The lid means has at least lid one wall member juxtaposed to at least a portion of the tray wall member. The lid wall member has at least one flap member, which is movable from a substantially closed position to a substantially open position, and which is disposed so as to be positionable over, juxtaposed and attachable at least a portion of the integrated separable member of the tray means.

This attachment of the flap member of the lid means to at least a portion of the integrated separable member of the tray means, when the flap member is in its substantially closed position, serves to maintain the lid means and the tray means integrated into a unitary shipping container.

Movement of the flap member from its substantially closed position to its substantially open position results in the separation of the integrated separable member attached to the flap member from the tray wall member of the tray means, permitting removal of the lid means from the tray means, and, in turn, converts the tray means absent the frangibly integrated separable member into the display apparatus for the goods.

In the preferred embodiments, the integrated separable member is frangibly integrated with and separable from the tray wall member.

In one preferred embodiment, at least one tray wall member further includes a fully frangible score region which fully encircles the periphery of the integrated separable member. This score region enables complete separation of the integrated separable member from the tray wall member.

Flap opening means are provided in at least one of the tray means and the lid means for facilitating movement of the flap member of the lid means from its substantially closed position to its substantially open position.

In one preferred embodiment, the flap opening means comprises at least one prompting tab member integrally associated with the flap member of the lid means. This prompting tab member articulates in order to facilitate movement of the flap member from its substantially closed position to its substantially open position. This, in turn, facilitates complete separation of the integrated separable member from the tray means.

Also, in this preferred embodiment, at least one separable member has a substantially inverted trapezoidal configuration. The separation of the at least one separable member from the tray means forms a handle aperture through the tray wall member.

Also in a preferred embodiment, the tray means and lid means each have substantially rectangular configurations. Moreover, the lid wall member of the lid means is substantially taller in height than the tray wall member of the tray means.

The tray means has two side wall members, a front wall member, and a back wall member. In one preferred embodiment, the front wall member is substantially shorter in height than each of the side wall members. The back wall member is substantially equal in height to the two side wall members.

In both preferred embodiments, each of the two side wall members includes an associated integrated separable member. The lid means includes two opposing lid side wall members, each including an associated flap member, with each flap member being positionable over, juxtaposed and attachable to corresponding integrated separable member.

Goods insertion means are provided-for enabling the placement of the goods into the shipping container apparatus when the flap member of the lid means is attached to the separable member of the tray means. The goods insertion means comprises at least one top flap member operably attached to the lid means proximate a top end of the lid means. This top flap member is movable from an open position, for placement of the goods into the shipping container apparatus, to a closed position, for retaining the goods within the apparatus during shipping and storage thereof.

In another preferred embodiment, the flap opening means comprises at least one opening which is integrally formed in the tray means, in either the bottom panel member or the tray wall member. This opening permits insertion of an object behind at least a portion of the frangibly integrated separable member, so as to facilitate the complete separation of the frangibly integrated separable member from the tray means.

The lid means and tray means are preferably constructed from corrugated paperboard materials. An adhesive is provided which is capable of effecting a paperboard to paperboard bond. This adhesive is disposed between and attaches the flap members of the lid means to the frangibly integrated separable members of the tray means. This adhesive may comprise a cold resin adhesive, such as a polyvinyl acetate adhesive. Alternatively, this adhesive may comprise a hot-melt type adhesive.

DETAILED DESCRIPTION OF THE DRAWINGS

Figure 1:
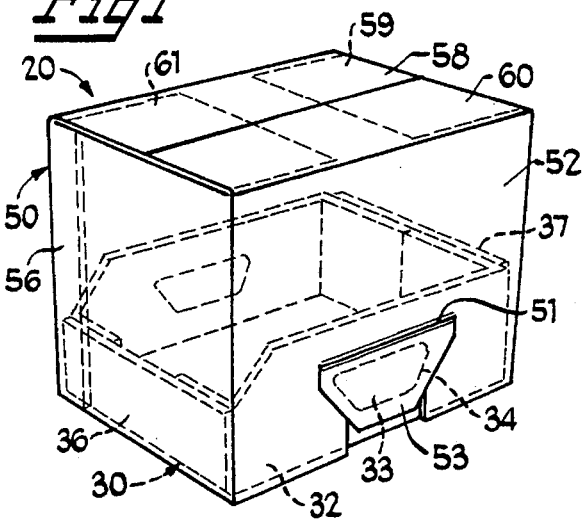
FIG. 1 of the drawings is a perspective view of a shipping container apparatus embodying the present invention, showing, in particular, the lid attached to the tray, forming a fully enclosed shipping container.

While this invention is susceptible of embodiment in many different forms, there are shown in the drawings and will herein be described in detail, several specific embodiments, with the understanding that the present disclosure is to be considered as an exemplification of the principles of the invention and is not intended to limit the invention to the embodiments illustrated.

One preferred embodiment of the present shipping container apparatus 20 is shown in FIGS. 1–5 as comprising tray means 30 and lid means 50. Tray means 30 and lid means 50 are both preferably constructed from a corrugated paperboard material. Tray means 30 include tray bottom panel member 31, two opposing tray side wall members 32, tray front wall member 36, and tray back wall member 37. Each tray side wall member 32 further includes a frangibly integrated separable member 33, surrounded by a fully frangible score region 34.

Lid means 50, releasably attachable to tray means 30, includes two opposing lid side wall members 52, lid front wall member 56, and lid back wall member 57. Each lid side wall member 52 further includes a flap member 53, articulating from lid side wall member 52 at fold line 51.

Figure 2:
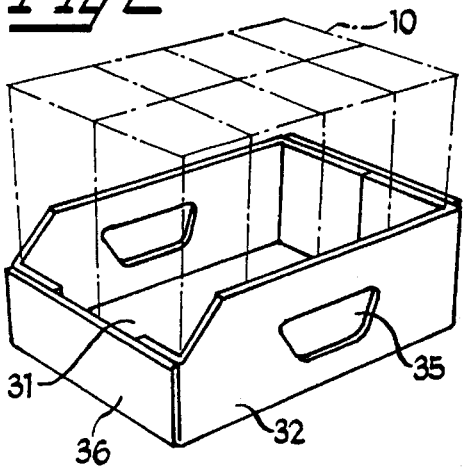
FIG. 2 of the drawings is a perspective view of the tray portion of FIG. 1, with the lid removed, showing, in particular, use of the tray as a display apparatus for goods.

As shown in FIG. 2, tray means 30 carries goods 10, which are covered during shipping and storage by attachable lid means 50. Removal of lid means 50 from tray means 30 exposes goods 10, and thus converts tray means 30 into a display apparatus for goods 10.

As shown in FIG. 1, lid means 50 is positionable over and attachable to tray means 30. As shown in detail in FIGS. 3 and 5, adhesive 90, capable of effecting a paperboard to paperboard bond, is disposed between and affixes a portion of flap member 53 of lid means 50 to frangibly integrated separable member 33 of tray means 30. Adhesive 90 is preferably a cold resin adhesive, such as a polyvinyl acetate adhesive, or a hot-melt type adhesive. Lid means 50 is thus securely affixed to tray means 30 so as to cover goods 10 during shipping and storage of apparatus 20.

Figure 3:
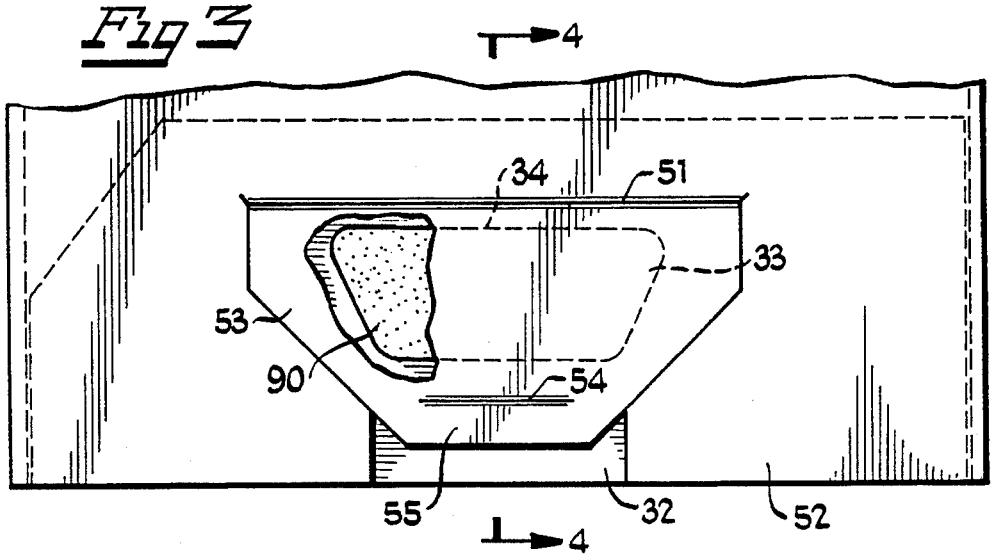
FIG. 3 of the drawings is an enlarged, fragmentary view of the shipping container apparatus of FIG. 1, partially in section, showing the flap member in its substantially closed position.
Figure 4:
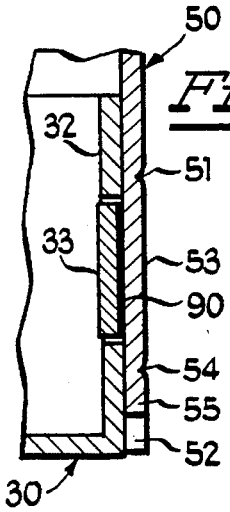
FIG. 4 of the drawings is a fragmentary view of the shipping container apparatus of FIG. 1, taken generally along lines 4—4 of FIG. 3, and looking in the direction of the arrows.

As shown in detail in FIG. 3, frangibly integrated separable member 33 has a substantially inverted trapezoidal configuration. The diagonal sides of this configuration serves to reduce the likelihood (as compared, for instance, to vertical sides) of accidently shearing frangibly integrated separable member 33 from tray means 30, upon the placement of an upward load or lifting force upon lid means 50.

Figure 5:
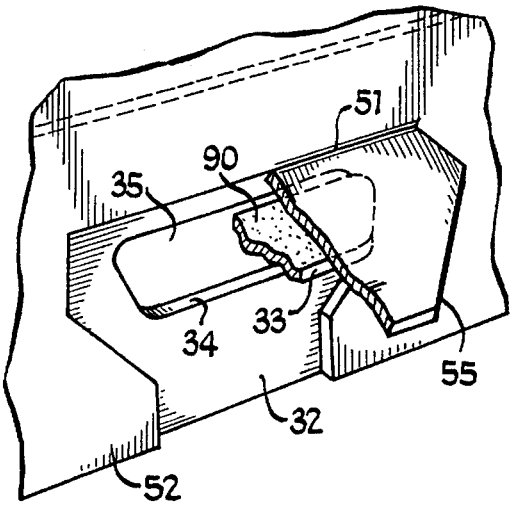
FIG. 5 of the drawings is a fragmentary, perspective view of the shipping container apparatus of FIG. 1, partially in section, showing the flap member in its substantially open position.
Figure 6:
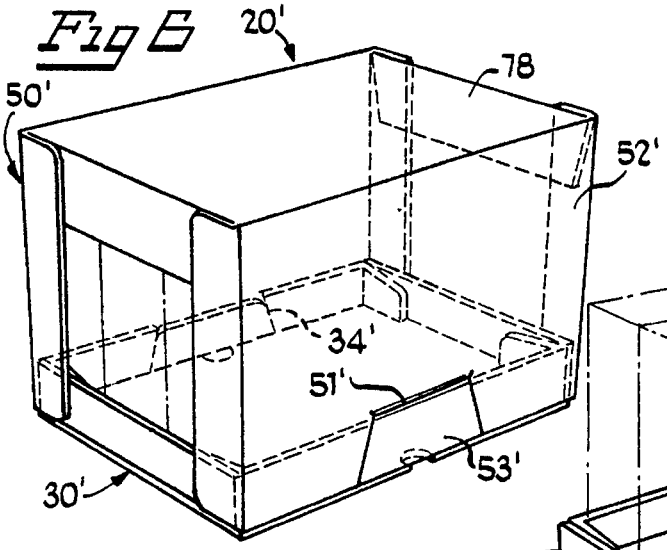
FIG. 6 of the drawings is a perspective view of another embodiment of the present shipping container apparatus invention, showing, in particular, the lid attached to the tray, forming a fully enclosed shipping container.

Lid means 50 further includes flap opening means for facilitating movement of flap member 53 from its substantially closed position (FIGS. 1 and 3) to its substantially open position (FIG. 5). In this preferred embodiment, the flap opening means comprise prompting tab member 55, which articulates from fold line 54 of each tray side wall member 52. By pulling upon prompting tab member 55, flap member 53 is moved from its substantially closed position to its substantially opened position. Inasmuch as frangibly integrated separable member 33 of tray means 30 is affixed to a portion of flap member 53, this, in turn, causes frangibly integrated separable member 33 to separate from its associated tray side wall member 32 at fully frangible score region 34. Once both flap members 53 have in turn been moved to their substantially open position, and both frangibly integrated separable members 33 have in turn been separated from tray means 30, lid means 50, formerly affixed to tray means 30, may be lifted vertically and separated from tray means 30. This, in turn, exposes goods 10 for display purposes within tray means 30. In addition, handle aperture 35 is now exposed within each tray side wall member 32 to facilitate the carrying of tray means 30.

As shown in FIG. 1, lid means 50 further include goods insertion means for enabling placement of goods 10 into shipping container apparatus 20 after lid means 50 is attached to tray means 30. In particular, as shown in FIG. 1, lid top flap members 58, 59, 60 and 61 are provided. These lid top flap members each articulate at an associated fold line and are moveable from an open position for placement of goods into shipping container apparatus 20, to a closed position for retaining the goods within the apparatus. An adhesive, or adhesive tape, may be employed to seal the lid top flap members in the closed position. These lid flaps may alternatively be located at other positions along the lid, such as the front or rear.

Figure 12:
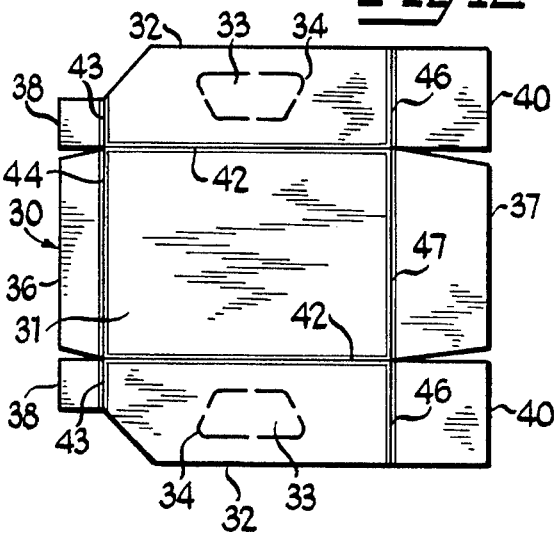
FIG. 12 of the drawings is a top plan view of the unerected tray blank of the shipping container apparatus of FIG. 1.

Tray means 30, shown in unerected form in FIG. 12, is erected as follows. Tray side wall members 32, along with associated tab members 38 and 40, are folded along their respective fold lines 42, toward the observer, as FIG. 12 is viewed. Tab members 38 and 40 are each folded inwardly at their respective fold lines 43 and 46, substantially perpendicular to their associated tray side wall members 32. Next, tray front wall member 36 is folded vertically along fold line 44, substantially perpendicular to tray bottom panel member 31. Adhesive is employed to affix the overlapping regions of tab members 38 to tray front wall-member 36. Finally, tray back wall member 37 is folded vertically along fold line 47 into substantially perpendicular relation to tray bottom wall member 47. Adhesive is employed to affix the overlapping portions of tab members 40 to tray back wall member 37. The preceding articulations leave tray means 30 in the configuration shown in FIG. 1.

Figure 11:
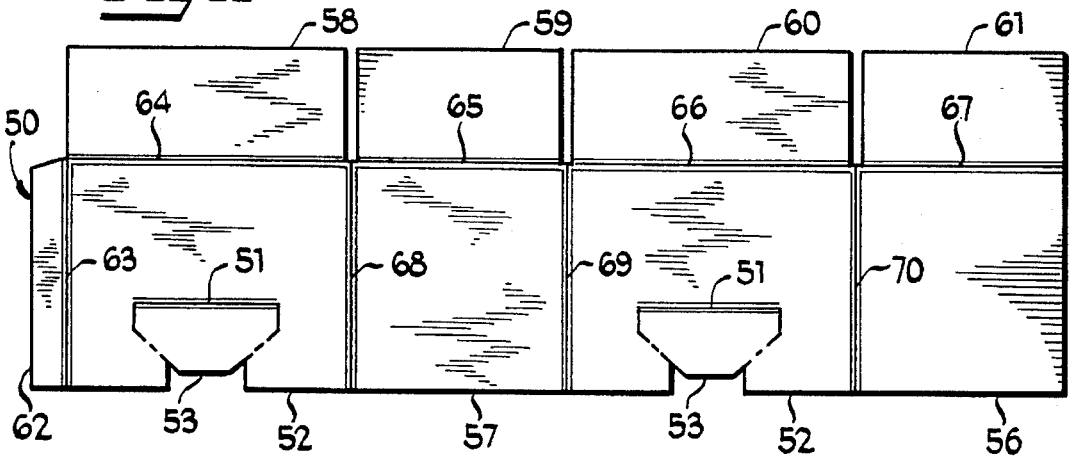
FIG. 11 of the drawings is a top plan view of the unerected lid blank of the shipping container apparatus of FIG. 1.

Lid means 50, shown in unerected form in FIG. 11, is erected as follows. Lid back wall member 57 is folded vertically along fold line 68, to an orientation substantially perpendicular to lid front wall member 52, towards the observer as FIG. 11 is viewed. Next, the lid side wall member 52 adjacent to fold line 69 is folded along fold line 69 such that lid side wall members 52 are substantially parallel to and opposing each other. Tab member 62 is folded vertically, towards the observer along fold line 63, to an orientation substantially perpendicular to its attached lid side wall member 52. Lid front wall member 52 is folded along fold line 70, to an orientation substantially parallel to and opposing lid back wall member 57. Next, the overlapping portions of tab member 62 and lid front wall member 56 are affixed with an adhesive.

When desired, the top portion of lid means 50 may be sealed as follows. Flap members 59 and 61 are folded along their respective fold lines 65 and 67 towards each other and to a position substantially perpendicular to their associated front and back lid wall members. Next, flap members 58 and 60 are folded towards each other, along their respective fold lines 64 and 66. Overlapping portions of flap members 58, 59, 60 and 61 may be attached to each other with adhesive. Alternatively, an adhesive tape may be employed to seal flap members 58 and 60 to each other.

Another preferred embodiment of the present shipping container apparatus 20' is shown in FIGS. 6–10 as comprising tray means 30' and lid means 50'. Tray means 30' includes two opposing tray side wall members 32', each having a frangibly integrated separable member 33'. Score lines 34' enable separation of frangibly integrated separable member 33' from tray means 30', Lid means 50' includes two opposing lid side wall members 52'. Each lid side wall member 52' includes a flap member 53', articulating with respect to associated lid side wall member 52' at fold line 51'. As in the previous preferred embodiment, lid means 50' is positionable over, and attachable to tray means 30'. Upon such positioning, tray means 30' is attached to lid means 50' by adhesive 90', disposed between and affixing frangibly integrated separable member 33' of tray means 30' to a portion of flap member 53' of lid means 50'. Also, as in the previous preferred embodiment, frangibly integrated separable member 33' has a substantially inverted trapezoidal configuration.

Figure 7:
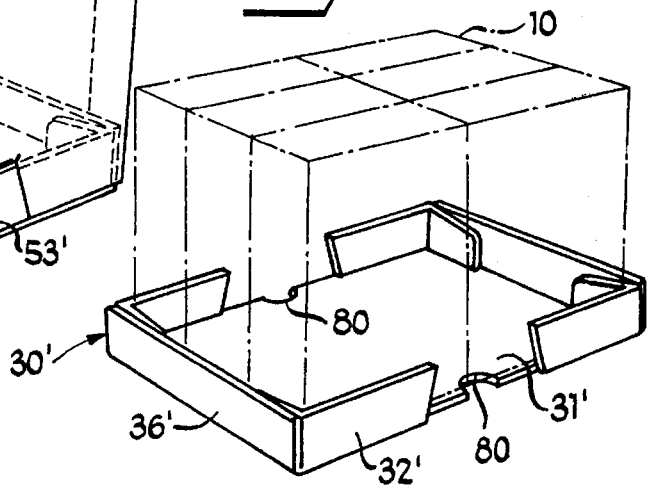
FIG. 7 of the drawings is a perspective view of the tray portion of the shipping container apparatus of FIG. 6, showing, in particular, the lid removed and use of the tray as a display apparatus for goods.
Figure 10:
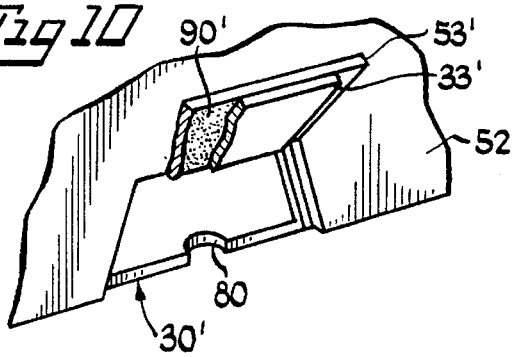
FIG. 10 of the drawings is a fragmentary, perspective view of the shipping container apparatus of FIG. 6, showing, in particular, the flap member in its substantially open position.

As shown in FIG. 7, tray means 30' includes two apertures 80 through tray bottom wall member 31'. Each aperture 80, integrally formed in tray means 30', provides flap opening means for facilitating movement of flap member 33' from its substantially closed position (FIGS. 6 and 8) to its substantially open position (FIG. 10). In particular, each aperture 80 permits insertion of an object within shipping container apparatus 20' and behind a proximate flap member 53', so that outward pressure may be applied directly to frangibly integrated separable member 33', and in turn flap member 53', towards moving flap member 53' to its substantially open position.

Figure 8:
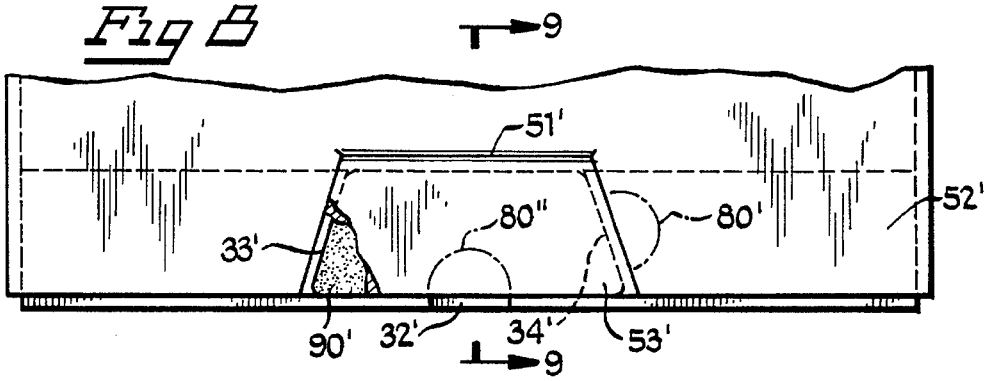
FIG. 8 of the drawings is an enlarged fragmentary plan view of the shipping container apparatus of FIG. 6, partially in section, showing, in particular, the lid attached to the tray.
Figure 9:
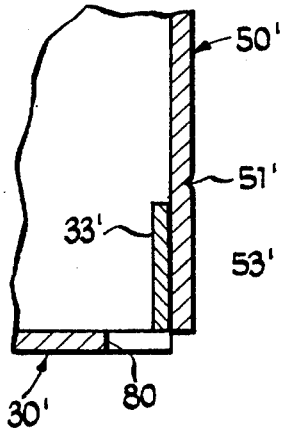
FIG. 9 of the drawings is a fragmentary view of the shipping container apparatus, taken generally along lines 9—9 of FIG. 8, and looking in the direction of the arrows.

As shown in FIG. 8, apertures 80 may alternatively or additionally be integrally formed through lid side wall member 52' and corresponding portions of tray side wall member 32' (as shown by reference numerals 80' and 80").

Movement of flap member 53' from its substantially closed position (FIG. 8) to its substantially open position (FIG. 10), in turn, causes separation of frangibly integrated separable member 53' from tray means 30' along score lines 34'. This, in turn, enables lid means 50' to be lifted away and separated from tray means 30', exposing goods 10 for display purposes.

Figure 14:
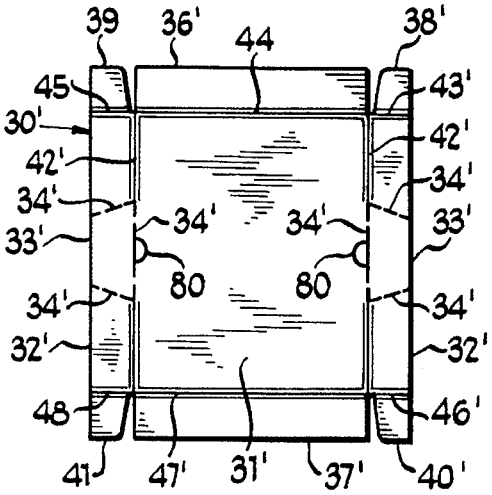
FIG. 14 of the drawings is a top plan view of the unerected tray blank of the shipping container apparatus of FIG. 6.

Tray means 30', shown in unerected form in FIG. 14, is erected as follows. Tray side wall members 32' are folded along their associated fold lines 42' towards the observer, as FIG. 14 is viewed, to an orientation substantially perpendicular to tray bottom panel member 31'. Next, tab members 38', 39, 40', and 41 are each folded inwardly, along their respective fold lines 43', 45, 46' and 48, to orientations substantially perpendicular to tray side wall members 32'. Tray front wall member 36' is folded vertically along fold line 44', to an orientation substantially perpendicular to tray bottom panel member 31'. Tab members 38' and 39 are affixed with an adhesive to overlapping portions of tray front wall member 36'. Similarly, tray back wall member 37' is folded along fold lines 47' to an orientation substantially perpendicular to tray bottom panel member 31'. Tab members 40' and 41 are affixed with adhesive to overlapping portions of tray back wall member 37'. The preceding articulations leave tray means 30' in the configuration shown in FIG. 6.

Figure 13:
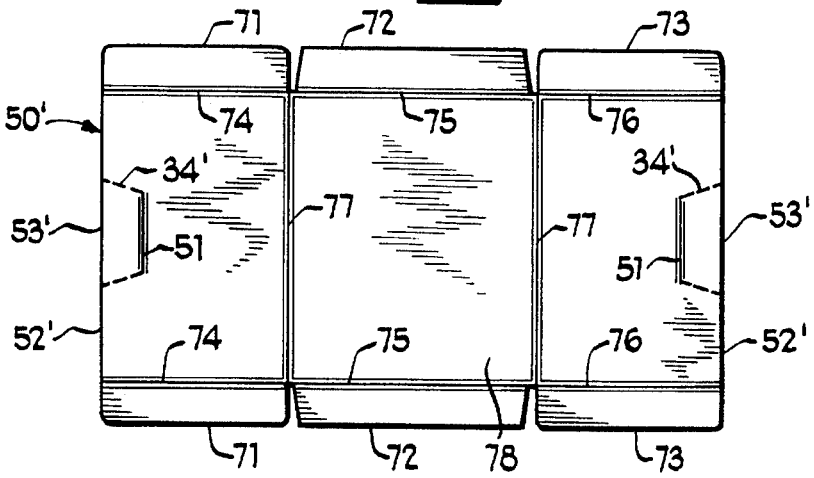
FIG. 13 of the drawings is a top plan view of the unerected lid blank of the shipping container apparatus of FIG. 6.

Lid means 50', shown in unerected form in FIG. 13, is erected as follows. Lid side wall members 52' are each folded along their respective fold lines 77 toward the observer, as FIG. 13 is viewed, to an orientation substantially perpendicular to lid top wall member 78. Next, tab members 72 are folded vertically along their respective fold lines 75 to an orientation substantially perpendicular to lid top panel member 78. Each pair of tab members 71 and 73 are folded inwardly, along respective fold lines 74 and 76, towards each other to positions substantially perpendicular to their associated lid side wall members 52'. Finally, overlapping portions of tab members 71, 72 and 73 are affixed to each other with an adhesive. The preceding articulations leave lid means 50' in the configuration shown in FIG. 6.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A shipping container apparatus for goods, said shipping container apparatus being convertible for use as a display apparatus for said goods, said shipping container apparatus comprising:

tray means for holding and displaying said goods, said tray means having a bottom panel member and at least one tray wall member, said at least one tray wall member of said tray means having at least one integrated separable member; and lid means releasably attached to said tray means for covering said goods during shipping, said lid means having at least one lid wall member juxtaposed to at least a portion of said at least one tray wall member, said at least one lid wall member of said lid means having at least one flap member, said at least one flap member being movable from a substantially closed position to a substantially open position, said at least one flap member of said lid means being disposed so as to be positionable over, juxtaposed and attachable to at least a portion of said at least one integrated separable member of said tray means, said attachment of said at least one flap member of said lid means to said at least a portion of said at least one integrated separable member of said tray means, while said flap member is in said substantially closed position, maintaining said lid means and said tray means integrated as a shipping container, movement of said at least one flap member from said substantially closed position to said substantially open position resulting in separation of said at least one integrated separable member attached to said flap member, from said at least one tray wall member of said tray means, said separation of said integrated separable member from said at least one tray wall member permitting removal of said lid means from said tray means to, in turn, convert said tray means into said display apparatus for said goods.

2. The shipping container apparatus according to claim 1, wherein said integrated separable member is frangibly integrated with and separable from said at least one tray wall member.

3. The shipping container apparatus according to claim 2, wherein said at least one tray wall member further includes a fully frangible score region fully encircling a periphery of said at least one frangibly integrated separable member to enable complete separation of said at least one frangibly integrated separable member from said at least one tray wall member.

4. The shipping container apparatus according to claim 1, wherein said apparatus further includes flap opening means in at least one of said tray means and said lid means for facilitating movement of said at least one flap member in said lid means from said substantially closed position to said substantially open position.

5. The shipping container apparatus according to claim 4, wherein said flap opening means comprises at least one opening integrally formed in said tray means in at least one of said bottom panel member and said tray wall member, said at least one opening permitting insertion of an object behind at least a portion of said at least one frangibly integrated separable member towards facilitating complete separation of said at least one integrated separable member from said tray means.

6. The shipping container apparatus according to claim 4, wherein said flap opening means comprises at least one prompting tab member integrally associated with said at least one flap member, said at least one prompting tab member articulating to facilitate movement of said at least one flap member from said substantially closed position to said substantially open position, and in turn, to facilitate complete separation of said at least one integrated separable member from said tray means.

7. The shipping container apparatus according to claim 1, wherein said at least one integrated separable member has a substantially inverted trapezoidal configuration.

8. The shipping container apparatus according to claim 1, wherein said separation of said at least one integrated separable member from said tray means forms at least one handle aperture through said at least one tray wall member of said tray means.

9. The shipping container apparatus according to claim 1, wherein said tray means has a substantially rectangular configuration.

10. The shipping container apparatus according to claim 1, wherein said lid means has a substantially rectangular configuration.

11. The shipping container apparatus according to claim 1, wherein said tray means has two side wall members and a front wall member, said front wall member being substantially shorter in height than each of said two side wall members.

12. The shipping container apparatus according to claim 11, wherein said tray means further includes a back wall member substantially equal in height to each of said two side wall members.

13. The shipping container apparatus according to claim 1, wherein:

said tray means includes two opposing tray side wall members, each of said tray side wall members including a corresponding integrated separable member; and said lid means includes two opposing lid side wall members, each of said lid side wall members including a corresponding flap member, each said flap member being disposed so as to be positionable over, juxtaposed and attachable to at least a portion of a corresponding integrated separable member, respectively.

14. The shipping container apparatus according to claim 1, wherein said apparatus further includes goods insertion means for facilitating the placement of said goods into said apparatus when said at least one flap member of said lid means is attached to said at least one separable member of said tray means, and, in turn, when said lid means is attached to said tray means.

15. The shipping container apparatus according to claim 14, wherein said goods insertion means comprises at least one top flap member operably attached to said lid means proximate a top end of said lid means, said at least one top flap member being moveable from an open position for placement of said goods into said apparatus to a closed position for retaining said goods within said apparatus.

16. The shipping container apparatus according to claim 1 wherein said lid means and said tray means are constructed from corrugated paperboard materials.

17. The shipping container apparatus according to claim 16, wherein said apparatus further includes an adhesive capable of effecting a paperboard to paperboard bond disposed between and attaching said at least one flap member of said lid means and said at least one integrated separable member of said tray means.

18. The shipping container apparatus according to claim 17, wherein said adhesive comprises a cold resin adhesive.

19. The shipping container apparatus according to claim 18, wherein said cold resin adhesive comprises a polyvinyl acetate adhesive.

20. The shipping container apparatus according to claim 17, wherein said adhesive comprises a hot-melt type adhesive.

* * * * *